United States Patent [19]

Grable

[11] Patent Number: 4,553,298

[45] Date of Patent: Nov. 19, 1985

[54] METHOD FOR FABRICATING A RECIPROCATING PISTON PUMP

[76] Inventor: William A. Grable, Box O, Wayne, Okla. 73095

[21] Appl. No.: 634,357

[22] Filed: Jul. 25, 1984

Related U.S. Application Data

[62] Division of Ser. No. 376,698, May 10, 1982, Pat. No. 4,477,237.

[51] Int. Cl.[4] ..... B23P 15/00

[52] U.S. Cl. ..... 29/156.4 R; 29/281.1; 29/281.5; 29/464; 29/559; 29/DIG. 48; 227/152

[58] Field of Search ..... 29/156.4 R, 281.1, 281.5, 29/462, 464, 559, DIG. 48; 227/152; 228/160, 170; 269/43, 246; 417/454, 521, 534, 539

[56] References Cited

U.S. PATENT DOCUMENTS

| | | | |
|---|---|---|---|
| 1,111,943 | 9/1914 | Bennett | 269/43 |
| 1,604,483 | 10/1926 | Roberts | 269/43 X |
| 1,673,943 | 6/1928 | Herr | 29/156.4 R |
| 2,331,513 | 10/1943 | Stahl | 417/539 X |
| 2,444,963 | 7/1948 | Taylor | 417/539 |
| 3,935,633 | 2/1976 | Bunker | 29/559 |

*Primary Examiner*—Howard N. Goldberg
*Assistant Examiner*—Ronald S. Wallace
*Attorney, Agent, or Firm*—Hubbard, Thurman, Turner & Tucker

[57] ABSTRACT

A fabricated reciprocating piston pump having a power end frame characterized by spaced apart elongated precut steel plate members forming the frame sidewalls and forming bearing support members for supporting the jackshaft and eccentric shaft bearings. The shaft bearings are mounted in cylindrical sleeves which are supported by respective pairs of the frame plate members. The pump includes crossheads which are of rectangular cross-sectional shape having flat parallel bearing surfaces and which are supported in the frame by elongated crosshead slide plates which may be adjusted laterally and vertically to align the crossheads with the axis of reciprocation of the pump piston rods. The pump fluid end is made up of premachined cylindrical tube and bar stock sections which are welded together into a unitary assembly including the pump cylinders, the suction and discharge valve housings, and the suction and discharge fluid manifolds. The power end frame is fabricated using a fixture for supporting precut steel plate members and premachined bearing support sleeve members whereby the power end frame may be fabricated by welding the frame members together in a fixture so that upon removal of the frame from the fixture, no further machining of the shaft bearing bores or the crosshead bearing surfaces is required.

6 Claims, 11 Drawing Figures

METHOD FOR FABRICATING A RECIPROCATING PISTON PUMP

This application is a division of application Ser. No. 376,698, filed May 10, 1982, now U.S. Pat. No. 4,477,237, issued Oct. 16, 1984.

BACKGROUND OF THE INVENTION

1. Field of the Invention

The present invention pertains to a reciprocating multi-cylinder piston pump of the type generally used for oil field mud and injection fluid pumping and which is of a fabricated substantially all welded construction of both the fluid end section and the power end section.

2. Background Art

There are many applications for reciprocating piston pumps which are particularly adapted for pumping relatively large volumes of fluid at pressures of 3,000 to 5,000 psig. One of the more demanding applications for this type of pump is in oil field rotary drilling mud circulation service and for pumping fluids used in processes for enhanced recovery of subterranean petroleum deposits. The historic cyclical demand for oil field drilling mud pumps, for example, has made the capital investment necessary for producing these types of pumps generally unattractive to many machinery manufacturers. Oil field mud pumps have traditionally been designed as duplex reciprocating types having a double acting piston and cylinder arrangement which dictates the utilization of a crosshead mechanism for interconnecting the piston rod with a crankshaft and connecting rod or eccentric assembly. This general design concept has resulted in the development of relatively large frames or crankcase housings for the crank or eccentric shaft and crosshead mechanism, which housings have traditionally been formed as large unitary iron or steel castings. By the same token, the fluid end or cylinder assemblies together with the cylinder heads and valve housings have also been formed as relatively large castings or fabricated from steel billets which have been machined to form the necessary cylinder bores and connecting fluid passageways. Prior art methods of manufacturing large reciprocating piston type pumps using cast crankcases or power ends as well as cast fluid end or cylinder assemblies have required sizable investments in machine tools necessary to form the bearing bores and the crosshead guide bores. Moreover, the capital investment required to manufacture casting patterns and provide the available foundry facilities has also contributed to the high cost of oil field type reciprocating pumps.

Notwithstanding the problems associated with the cost of capital equipment necessary for fabricating oil well drilling mud pumps and the like, the nature of the application of this type of pump also requires that the pump be moved frequently from one drilling site to another. It is therefore also desirable to provide a pump which is as lightweight as possible and at the same time is able to withstand the mechanical stresses endured in pumping relatively large volumes of drilling mud at high working pressures. For example, a typical prior art drilling mud pump, capable of delivering from 200 gallons per minute to 600 gallons per minute at 1,000 to 3,000 psig, respectively, may weigh up to 52,000 lbs. complete with a standard supporting frame or skid. A pump of the aforementioned capacity typically has input power requirements ranging from 700 to 800 hp.

Accordingly, there has been a longfelt need for the development of a suitable reciprocating pump which is relatively lightweight while yet capable of reliable service under the operating specifications such as those indicated hereinabove and which may be fabricated without the tooling and other capital equipment requirements associated with the manufacture of large machines.

There have been several efforts in the prior art of reciprocating pumps to develop pumps of fabricated construction such as the manufacture of the crankcase using built up construction of welded together or mechanically fastened together plate and other structural parts. However, prior art efforts have primarily been directed to pump structures which merely use fabricated parts instead of cast parts, and the assembled power end frames and fluid ends still require extensive machining operations with large boring equipment. In fact, the configuration of some prior art fabricated pump structures actually increases the weight of the pump versus the weight of a comparable pump using cast crankcase or power end housings as well as cast cylinder assemblies. The problems associated with the need to provide accurate alignment of the bearings and bearing supports for the pump drive mechanism, including the jackshaft, the crank or eccentric shaft and the crosshead guides, have not been overcome with prior art designs. However, several problems associated with efforts to design a suitable completely fabricated reciprocating piston pump have been overcome with the present invention as will be appreciated by those skilled in the art.

SUMMARY OF THE INVENTION

The present invention provides a substantially completely fabricated reciprocating piston pump, particularly of the type utilized for pumping large quantities of fluids such as well drilling mud and the like at relatively high pressures and flow rates, and wherein such a pump must be reliable in operation and adapted to be somewhat portable. In accordance with an important aspect of the present invention, there is provided a reciprocating piston pump having a power end or crankcase housing structure which is formed entirely of structural metal components available as standard mill shapes and which require a minimum of machining other than that which can be accomplished utilizing relatively small machine tools such as engine lathes or the like. The pump power end frame of the present invention is fabricated of a plurality of longitudinal plate members spaced apart to form the outer walls of a casing including crosshead guide supporting structure, said casing further including additional sets of spaced apart plates which form bearing support structure for the pump jackshaft and crankshaft bearings.

In accordance with another aspect of the present invention, there is provided a pump casing or power end frame in which bearing support members for the jackshaft and crankshaft bearings are formed from steel tube or cylindrical rod stock and are prebored before assembly with the power end frame structure so that, upon assembly of the power end frame, no further machining is necessary.

In accordance with another important aspect of the present invention, there is provided an improved crosshead and crosshead guide configuration which does not require precision machining of an integral part of the power end frame of the pump. The crosshead configuration of the present invention contemplates the provision of a crosshead member having a rectangular or square cross-sectional configuration forming substantially flat bearing surfaces which are in sliding engagement with longitudinal crosshead guides. The crosshead guides are advantageously formed as a plurality of platelike members which may be adjusted to provide accurate alignment of the crosshead with the linear reciprocating line of action of the piston rod and wherein the crosshead guides may be easily removed and new crosshead guides may be inserted and adjusted, as needed, to provide the desired alignment. In accordance with the improved crosshead guide arrangement, there is also provided an improved means for adjusting the position of the crosshead guides to provide the proper alignment of the crosshead and to adjust the clearances between the bearing surfaces of the crosshead and the crosshead guides.

Another important aspect of the present invention pertains to a reciprocating piston pump having a built up crankshaft or eccentric shaft assembly including a cylindrical shaft to which are removably mounted eccentrics or crank throw members having connecting rod shaft or crank pin portions which are also separately fabricated as cylindrical shaft elements and are force fitted into bores in the eccentric members. The pump jackshaft and eccentric shaft are supported in self-aligning rolling element type bearings, preferably spherical roller bearings, whereby minor misalignment of the bearing supports may be easily accommodated without imposing undue stress or friction on the rotating parts.

In accordance with a still further aspect of the present invention, the crank mechanism of the pump includes fabricated connecting rod and eccentric elements which may be conveniently cut from steel mill plate or billets and which may be conveniently machined on relatively small machine tools to provide suitable bores for mounting the eccentric on the eccentric shaft and for mounting the connecting rods on the crank pin portions.

In accordance with yet another aspect of the present invention there is provided a reciprocating piston pump of the so-called duplex type having a fabricated fluid end cylinder structure comprising a pair of spaced a part cylinder members which are interconnected by structure forming the fluid inlet and outlet manifolds together with housing members for the suction and discharge valves and wherein all of the aforementioned structure may be fabricated using standard structural metal tubing or cylindrical bar stock shapes. Accordingly, the fluid end structure may be prefabricated from generally cylindrical tube and bar components by machining the cylinder bores, the cylinder liner tubes, and the suction and discharge valve bores, on relatively small machine tools, such as engine lathes, and whereby these components are then subsequently assembled into a unitary fluid end structure by welding processes.

In accordance with a still further aspect of the present invention, there is provided a reciprocating piston pump of the duplex type which is relatively lightweight and wherein the power end frame or casing is formed integral with a supporting substructure or skid of the type typically used for oil well drilling pumps and the like, and wherein the supporting skid comprises structure which strengthens the power end frame.

The present invention also provides an improved method of fabricating a reciprocating piston pump, in particular the power end frame, wherein bearing support members for the pump jackshaft and eccentric shaft may be prebored and assembled with the additional frame structure so that, upon fabrication of the power end frame, no further machining of the frame structure is required. The improved method of fabricating a pump power end frame also includes the provision of a unique fixture or support structure for supporting the components of the power end frame so that they may be welded together to form a unitary frame structure which may then be conveniently removed from the supporting fixture.

Those skilled in the art of reciprocating piston pumps, particularly of the type designed for well drilling fluid service, will recognize the superior and unexpected improvements provided by the present invention upon reading the detailed description which follows in conjunction with the drawings.

DESCRIPTION OF THE PREFERRED EMBODIMENTS

Figure 1:
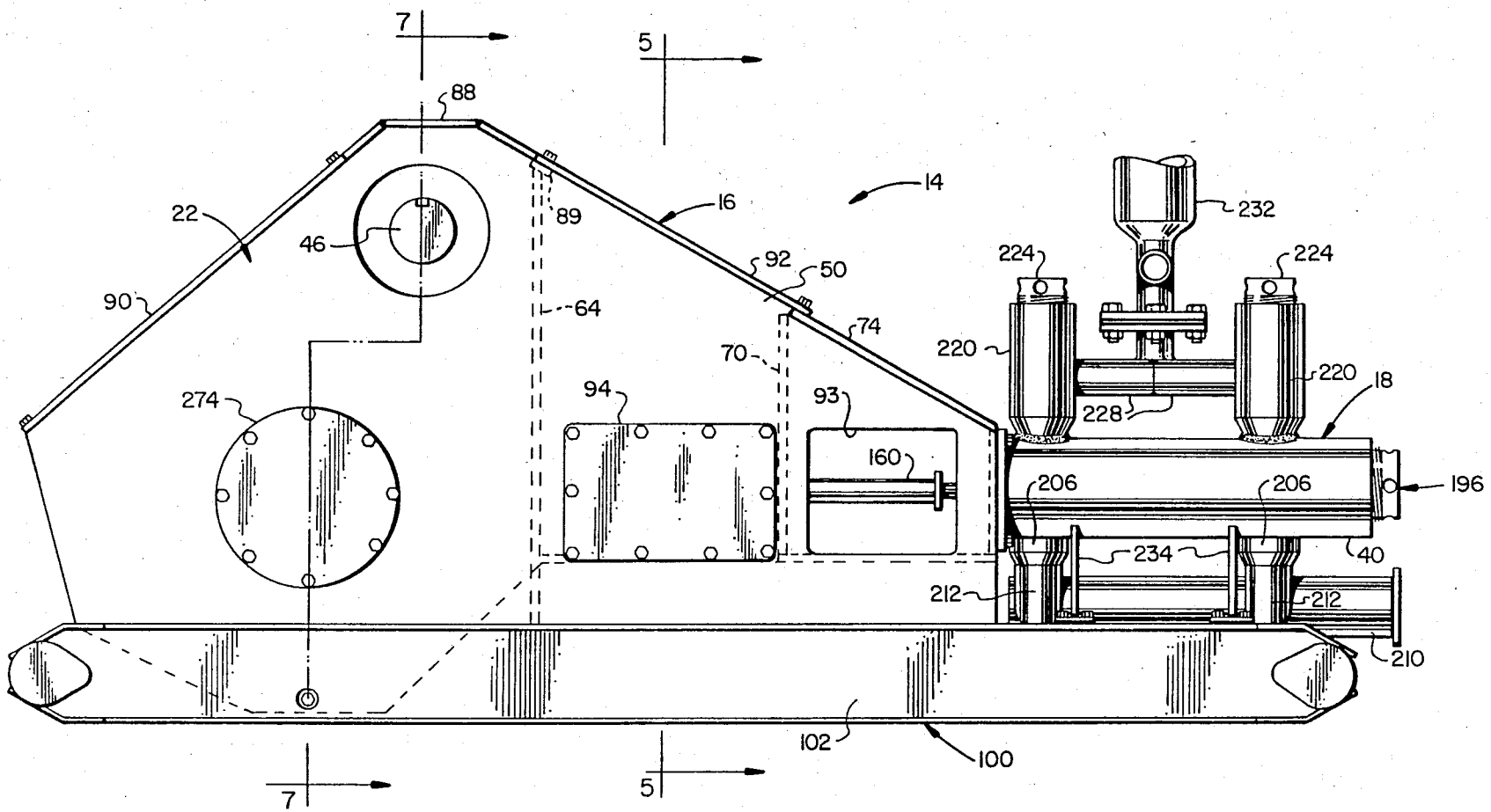
FIG. 1 is a longitudinal side elevation of the reciprocating piston pump of the present invention.

In the description which follows, like parts are generally marked throughout the specification and drawings with the same reference numerals, respectively.

Figure 2:
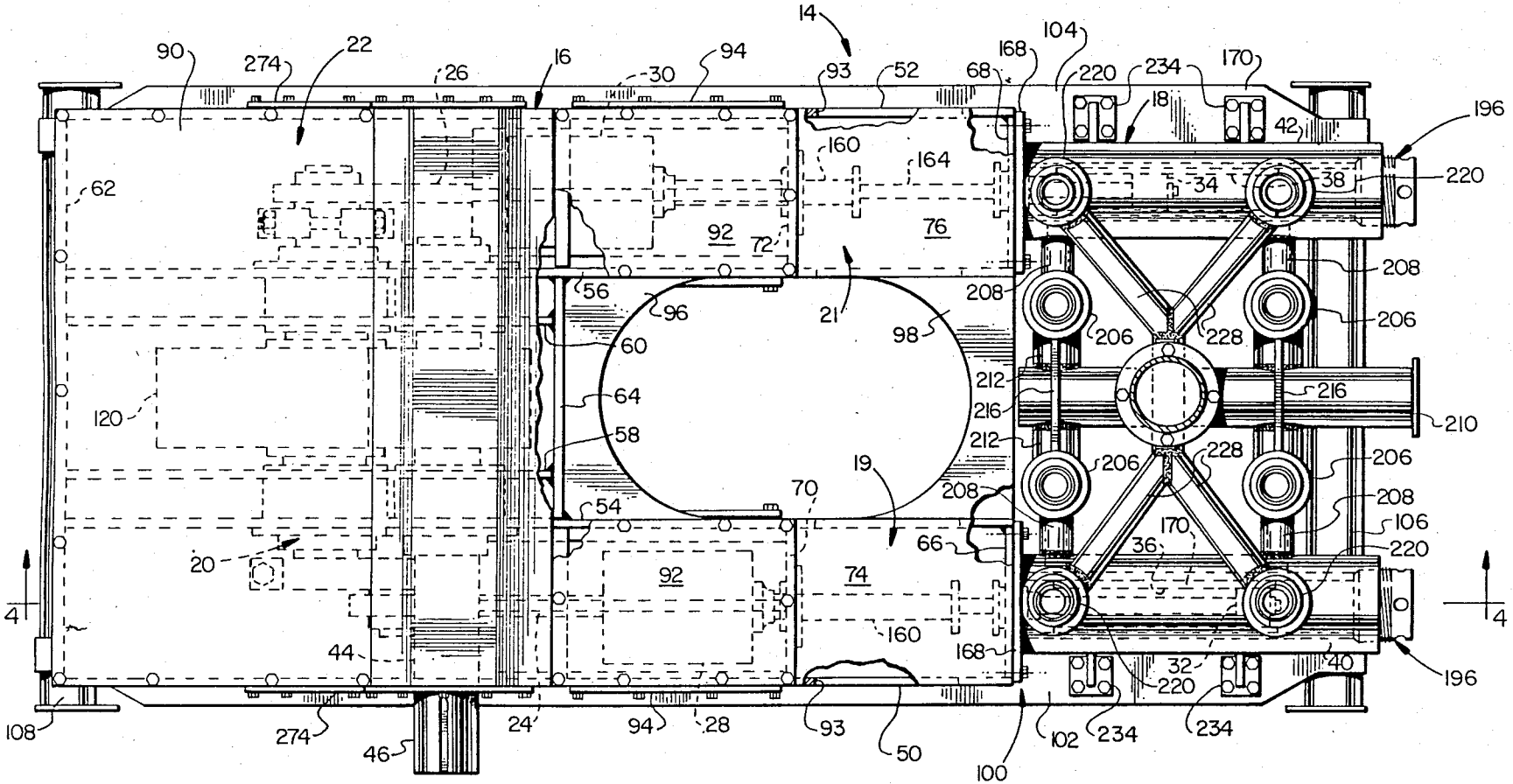
FIG. 2 is a plan view, partially broken away, of the pump illustrated in FIG. 1.
Figure 3:
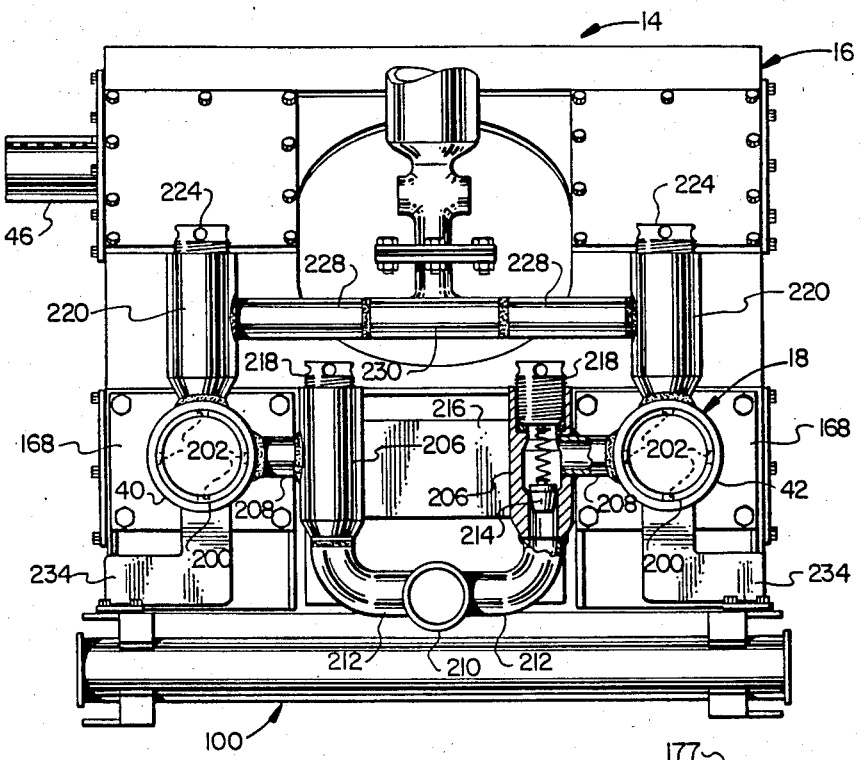
FIG. 3 is a transverse end view, partially sectioned, of the pump illustrated in FIGS. 1 and 2.

Referring to drawing FIGS. 1, 2 and 3, there is illustrated an improved reciprocating piston pump in accordance with the present invention which is particularly adapted for pumping circulation fluid or "mud" in the drilling or oil wells and the like. The pump according to the present invention, generally designated by the numeral 14, includes a power end frame or casing, generally designated by the numeral 16, and a fluid end section which is removably bolted to the power end frame and is generally designated by the numeral 18. The power end frame 16 comprises a casing for an elongated shaft 20, FIG. 2, which is characterized as a crankshaft or, in the art of reciprocating pumps, sometimes known as an eccentric shaft. The shaft 20 is mounted within a crankcase portion 22 of the power end frame on suitable bearings as will be explained in detail further herein. The eccentric shaft 20 is adapted to be connected to a pair of spaced apart connecting rods 24 and 26, which in turn are connected to respective crosshead members 28 and 30 for converting the oscillating connecting rod motion to linear reciprocating motion for reciprocating respective pump pistons 32 and 34 which are disposed within respective bores 36 and 38 formed within a pair of spaced apart cylinder assemblies 40 and 42. The cylinders 40 and 42 comprise a major portion of the fluid end section 18 and will also be described in further detail herein.

The power end frame 16 is also adapted to rotatably support a jackshaft 44 having a distal end portion 46 projecting from one side of the crankcase portion 22. The jackshaft 44 is adapted to include suitable means for drivably engaging the eccentric shaft 20 such as a sprocket and endless chain arrangement or a pinion and drive gear arrangement in accordance with conventional practice in the art of reciprocating piston pumps. The general arrangement of the jackshaft, eccentric shaft, crossheads and pistons as described hereinabove, is known in the art of reciprocating piston pumps. However, the combination of the various components of the pump 14 is believed to provide a unique fabricated structure which represents an improvement in the art of reciprocating pumps. In particular, the structural features of the power end frame 16 are believed to be advantageous and superior to prior art pumps in several respects.

Figure 4:
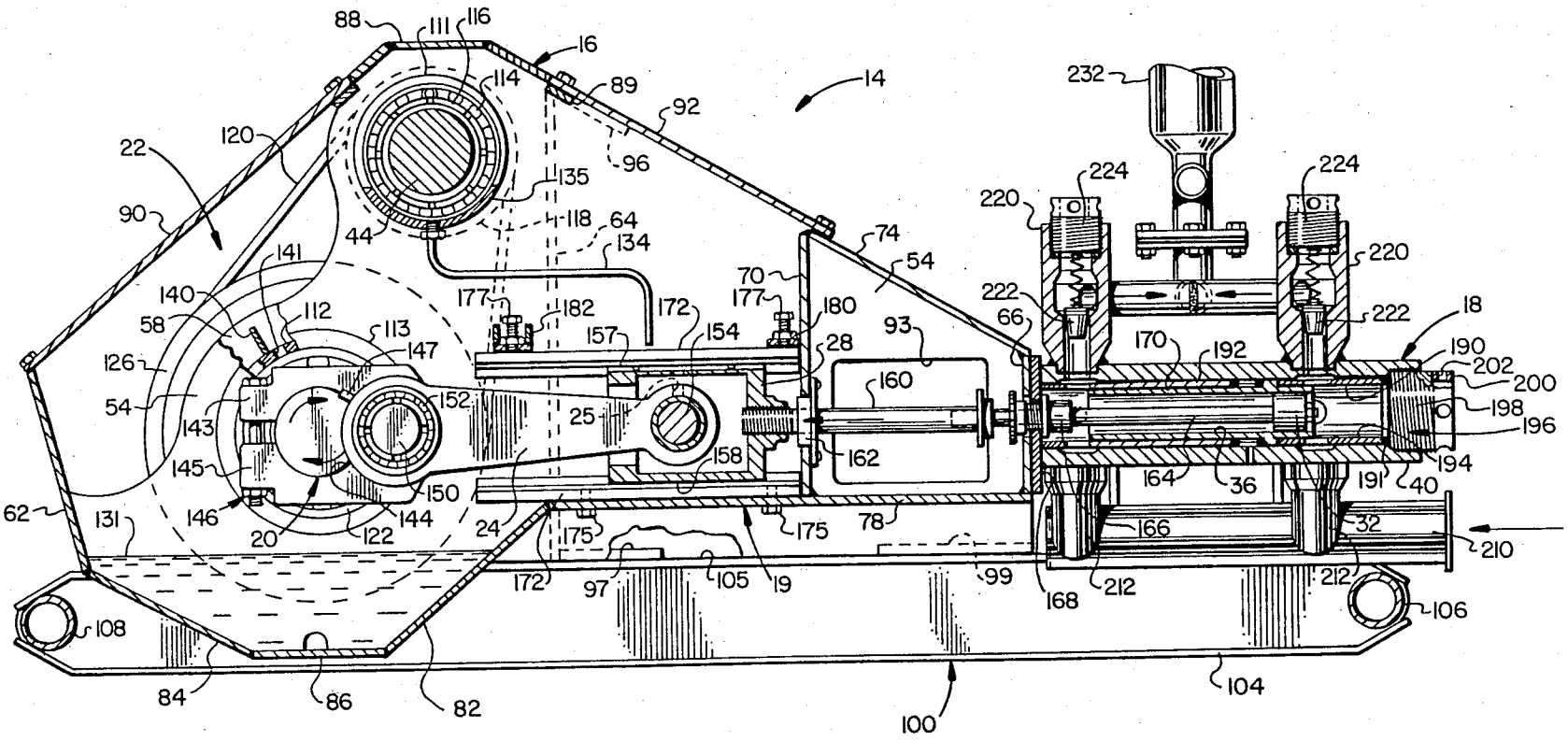
FIG. 4 is a longitudinal section view taken substantially along the line 4—4 of FIG. 2.
Figure 7:
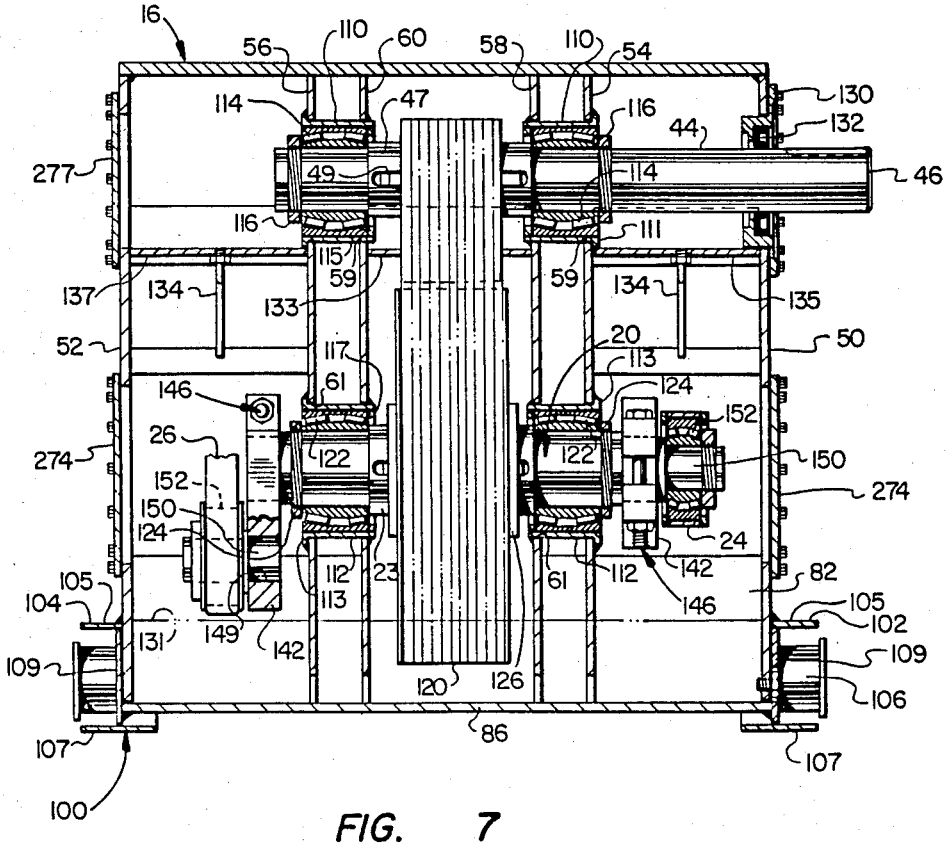
FIG. 7 is a section view taken substantially along the line 7—7 of FIG. 1.

Referring now to FIGS. 2, 4 and 7, the power end frame 16 includes a first pair of spaced apart and generally parallel flat plate members 50 and 52 which comprise the outer walls of the crankcase portion 22, and respective crosshead support portions 19 and 21. The power end frame 16 also includes a second pair of generally flat plate members 54 and 56 forming the opposite sidewalls of the respective crosshead support portions 19 and 21 and also forming the bearing support means for supporting the bearings of the eccentric shaft 20 and the jackshaft 44. The power end frame 16 further includes a third pair of spaced apart generally flat plate members 58 and 60 extending parallel to the first and second pairs of plate members described above. As shown in FIGS. 2 and 7, the plate members 58 and 60 are disposed between the plate members 54 and 56 and extend from a rear, vertically inclined wall 62 forward to a vertical, transverse wall 64 which extends between the plate members 54 and 56.

Figure 5:
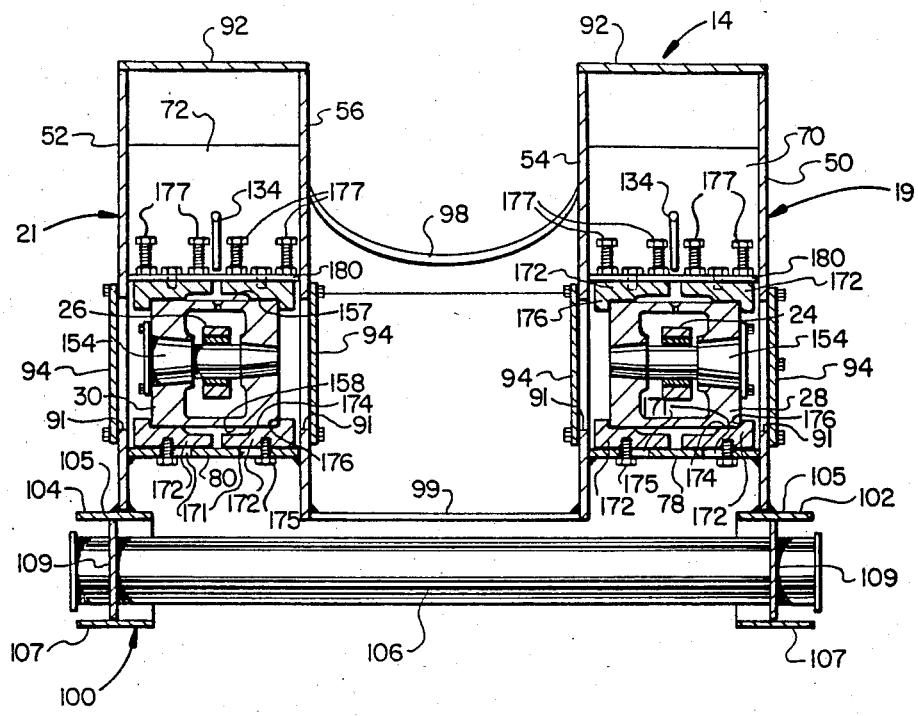
FIG. 5 is a section view taken substantially along the line 5—5 of FIG. 1.

The forward ends of the crosshead support portions 19 and 21 include, respectively, vertical extending plate members 66 and 68 which comprise mounting flanges for the respective cylinder members 40 and 42. The crosshead support portions 19 and 21 are also, respectively, provided with transversely extending vertical wall sections 70 and 72 spaced from the flanges 66 and 68, as indicated in FIGS. 2, 4 and 5. The wall portions 70 and 72 extend downward from integral top cover plate portions 74 and 76 to generally horizontally extending bottom walls 78 and 80, respectively. The horizontal bottom wall portions 78 and 80 extend from the flanges 66 and 68, respectively, toward the crankcase portion 22 to a point generally adjacent the vertical transverse plate 64, and extend between the vertical sidewalls of the crosshead support portions 19 and 21 to be contiguous with the respective pairs of plates 50–52 and 52–56.

The crankcase portion 22 is also characterized by a bottom pan portion comprising inclined sidewall parts 82 and 84. FIG. 4, which are contiguous along respective edges with a horizontal bottom wall 86. The wall parts 82, 84 and 86 extend between the outer sidewalls 50 and 52. The crankcase portion 22 is closed by an integral top wall portion 88 and a removable cover member 90. As shown in FIGS. 1, 2, 4 and 5, the crosshead support portions 19 and 21 are provided with suitable access openings 89, 91 and 93, the first two of which are covered by removable cover plates 92 and 94, to provide access to the crossheads 28 and 30 and the crosshead or pony rods. The power end frame 16 is also provided with suitable strengthening web members 96, 97, 98 and 99 which extend between the crosshead support portions 19 and 21.

The power end frame 16 is fabricated in accordance with a unique method, including a novel fabrication fixture according to the present invention, to comprise a unitary assembly made up of high strength steel plate which may be conveniently precut by known plate cutting techniques to the respective shapes illustrated in the drawing figures. The plates 50, 52, 54, 56, 58 and 60 are welded along their respective contiguous edges to the top wall 88, the vertically inclined crankcase wall part 62, and the crankcase bottom wall parts 82, 84 and 86. The vertically disposed transverse plate 64 is welded to the plate members 54, 56, 58 and 60 along respective contiguous edges. The flanges 66 and 68 are also welded to the respective distal ends of the plate members 50, 52, 54 and 56 also, along their respective contiguous edges. The plate member 78 is welded at its opposite ends to the members 66 and 82, respectively, and the plate member 80 is welded at its opposite ends to the plate members 68 and 82. Both of the plate members 78 and 80 are welded along their longitudinal opposed edges to the respective pairs of plate members 50–54 and 52–56 to form the respective crosshead support portions 19 and 21. The plate members 70 and 74 are also welded to the portions of the plate members 50 and 54 comprising the crosshead support portion 19 and, in a similar fashion, the plate members 72 and 76 are welded to the plate members 52 and 56 along the portions of these members comprising the crosshead support portion 21. Webs 96, 97, 98 and 99 are also welded along their respective contiguous edges to the adjacent portions of the plates 54 and 56, respectively. The webs 97 and 98 are also welded along a transverse edge to the plate member 64.

The lightweight and substantially rigid power end frame structure described herein, is further strengthened by forming the power end frame section 16 integral with a support skid generally designated by the numeral 100. Referring particularly to FIGS. 1, 4, 5 and 7, the skid 100 comprises a pair of spaced apart and parallel longitudinal beam members 102 and 104 which are interconnected at their opposite ends by transverse steel tubular sections 106 and 108. The skid 100 is constructed in accordance with oilfield equipment practice but has been adapted to form an integral part of the power end frame 16 and further strengthens the frame in accordance with the arrangement described hereinbelow. The beam members 102 and 104 are preferably of I beam or H beam construction including, as illustrated in FIGS. 5 and 7, opposed parallel flanges 105 and 107 which are integral with a connecting web 109. The beam members 102 and 104 are spaced apart such that the webs 109 are outside the adjacent crankcase outer wall portions formed by the plates 50 and 52. As shown in FIG. 4, by way of example, the longitudinal bottom edges of the plates 50 and 52 extending along the crosshead support portions 19 and 21, respectively, are disposed along the top edge of the beam flanges 105 and are welded thereto. The beam flanges 105 are cut away in the area of the crankcase portion 22 to accommodate the bottom wall of the crankcase portion and which forms a sump for lubricating oil. The flanges 105 may be welded to the bottom wall portions 82, 84 and 86 along respective contiguous edges and the opposed plate members 50 and 52 are also welded along contiguous edges with the respective web portions 109 of the beam members 102 and 104. Accordingly, the pump 14 is advantageously strengthened by welding the skid 100 to the outer sidewalls of the frame 16 to connect the frame to the skid and to strengthen the frame structure itself.

Referring now to FIGS. 4 and 7, in particular, the power end frame 16 is also provided with a unique arrangement for supporting the bearings which journal the jackshaft 44 and the eccentric shaft 20. As illustrated in FIG. 7, the pair of plates 54 and 58 and the pair of plates 56 and 60 are spaced apart from each other and are provided with suitable generally cylindrical openings 59 and 61 for receiving opposed cylindrical bearing support sleeves 110 and 112. The bearing support sleeves 110 and 112 are preferably formed by machining steel tube stock or the like to provide the sleeve members with integral flange portions 111 and 113, respectively, for locating the sleeve members against the respective plates 54 and 56 as illustrated. The sleeves 110 and 112 are assembled with the other structure comprising the power end frame 16 and are welded in place along their surfaces which are contiguous with the plates 54, 58, 56, and 60, respectively. The jackshaft 44 is supported in the sleeves 110 by spaced apart spherical self-aligning roller bearing assemblies 114. The bearing assemblies 114 are butted against opposed shoulders formed on the shaft portion 47 in accordance with conventional practice, and the shaft 44 is retained in assembly with the bearing assemblies 114 by opposed locknuts 116 threaded onto spaced apart threaded portions formed on the shaft 44 in a conventional manner. The central portion 47 of the shaft 44 is provided with an elongated keyway 49 for receiving a conventional drive key, not shown. The shaft 44 is adapted to drivably support a sprocket 118 for an endless roller drive chain 120.

In a similar manner, the eccentric shaft 20 is supported on a pair of spaced apart spherical roller bearing assemblies 122 which are disposed in respective ones of the bearing support sleeves 112. The bearings 114 and 122 are preferably of a type SD manufactured by The Torrington Company, Torrington, Conn. Each of the sleeves 110 and 112 is provided with inwardly projecting flange portions 115 and 117, respectively, which may be welded to the sleeves for retaining the bearings within the sleeves and to prevent lateral displacement of the respective shafts 44 and 20. The shaft 20 is also adapted to be threadedly engaged with opposed bearing locknuts 124 to prevent lateral displacement of the shaft out of the bearing assemblies 122. As shown in FIG. 7, the shaft 20 includes a central portion 23 provided with a suitable keyway for receiving a drive key for drivingly engaging a chain sprocket 126 mounted on the shaft portion 23 and also drivenly engaged with the endless chain 120. The distal end 46 of the shaft 44 extends through the sidewall of the crankcase portion 22, formed by the plate 50. A removable cover plate 130 containing a suitable shaft seal 132 is mounted on the plate 50.

The bearing assemblies 114 and 122 as well as the chain 120, are lubricated by a unique arrangement of oil collection and distribution structure which will now be described. Referring further to FIGS. 4 and 7, the sprocket 126 is of sufficient diameter that its lower portion is normally immersed in a quantity of oil which is maintained at a level indicated by the numeral 131. Accordingly, in operation, the sprocket 126 and the chain 120 are continually lubricated through immersion in lubricating oil and a considerable amount of oil is carried with the chain 120 upward and bathes the sprocket 118. Oil which drains away from the chain 120 and the sprocket 118, in the vicinity of the shaft 44, collects in a trough 133, FIG. 7, extending between the plates 58 and 60. Additional troughs 135 and 137 extend between the plates 50–54 and 52–56, as shown in FIG. 7 and also in FIG. 4. Oil collecting in the trough 133 accumulates to a level which will allow it to flow through the bearing assemblies 114 into the troughs 135 and 137. The cross-sectional shape of trough 135 is typical of the shape of the troughs 133 and 137 also. Oil accumulating in the troughs 135 and 137 flows through respective conduits 134 to lubricate the crossheads 28 and 30. The considerable distribution of oil throughout the interior of the crankcase portion 22 from the action of the sprocket 126 and the chain 120 will also result in the collection of oil in a small reservoir portion formed along the top surface of each of the sleeves 112 by a dam 140, one of which is illustrated in FIG. 4. The dams 140 extend between the respective pairs of plates 54–58 and 56–60. Each of the sleeves 112 is also provided with a passageway 141, shown by way of example in FIG. 4, which allows oil to drain from the aforementioned reservior formed by the outer surfaces of the sleeves and the dams 140 into the eccentric shaft bearings 122.

Referring further to FIGS. 4 and 7, the eccentric, connecting rod and crosshead arrangement will be described in connection with the connecting rod 24 and crosshead 28. It will be understood that the general arrangement is substantially identical for the connecting rod 26 and the crosshead 30. The distal ends of the eccentric shaft 20 are each adapted to support an eccentric member 142 comprising a steel, generally rectangular plate having a bore 144, FIG. 4, and adapted to have a pair of opposed jaw portions 143 and 145 which may be drawn together by bolt and nut assemblies 146 to clamp the eccentrics to the ends of the shaft 20, respectively. Cooperable drive key means 147 are also provided for locating the eccentrics to be out of phase with each other in accordance with the requirements of a particular pump. For example, in the duplex piston pump 14 of the present invention, the eccentrics 142 are positioned 90° out of phase with each other about the axis of rotation of the eccentric shaft 20. Accordingly, the eccentrics 142 are preferably fabricated as separate members which may be easily mounted on and demounted from the shaft 20. Moreover, the eccentrics 142 may be conveniently fabricated from standard steel plate or billet stock by being cut from stock and machined to form the bore 144 as well as a bore 149, FIG. 7, for receiving stub crank pins 150. The crank pins 150 are separately machined steel members which are preferably shrink fitted in the respective bores 149 to form a substantial interference fit. The crank pins 150 are adapted to support roller bearing assemblies 152, which are preferably of the spherical self-aligning type and, are retained on the crank pins by suitable bearing retaining nuts threadedly engaged with the pins.

Referring to FIG. 4, by way of example, the connecting rod 24, which is also preferably formed from steel plate or billet and flame cut to the preferred shape, is connected at its end opposite the crank pin 150 to the crosshead 28 by a suitable crosshead pin 154. The pins 154 are retained in tapered transverse bores formed in the sidewalls of each of the crossheads, as illustrated in FIG. 5. The crossheads 28 and 30 are identical in construction and are preferably formed of cast iron or steel and have a generally rectangular or square cross-sectional shape with opposed upper and lower bearing surfaces 157 and 158, respectively. Opposed side surfaces 257 and 258 of the crossheads 28 and 30 are also preferably machined to a suitable bearing finish. The crossheads 28 and 30 are also threadedly connected to one end of respective pony rod sections 160 which extend through respective oil stop heads 162 mounted on the frame plates 70 and 72. Again, as shown by way of example in FIG. 4, the pony rod 160 is threadedly engaged with a piston rod 164 extending through a stuffing box 166 mounted on a mounting flange 168 of the fluid end 18. Each of the cylinders 40 and 42 are provided with a mounting flange 168 which is bolted to the respective mounting flanges 66 and 68. One of the piston rods 164 is connected to piston 32, as shown in FIG. 4, which is reciprocable in the bore 36 formed by a removable cylinder liner 170. The other piston rod 164 is connected to piston 34, as shown in FIG. 2, and which is also reciprocable in a bore formed in a liner 170.

The inventive concept of the pump 14 contemplates that the method of fabrication of the power end frame 16 as well as the fluid end section 18 may require adjustment of the alignment of the crossheads 28 and 30 to minimize any lateral loading on the piston and pony rod assemblies 160–164. An improved crosshead guide arrangement has been developed in accordance with the present invention which will now be described in conjunction with FIGS. 4, 6, 7 and 8. Referring to FIGS. 4 and 5, each of the crossheads 28 and 30 is supported on its lower side by a pair of spaced apart longitudinal extending crosshead slide plates 172 which are provided with machined bearing surfaces 174 and machined flange portions 176 extending at right angles to the bearing surfaces 174. The lower crosshead slide plates 172 are secured to the crosshead support plates 78 and 80 by suitable bolts 175. The plates 172 may be adjusted laterally with respect to each other by the provision of suitable elongated transverse slots 171 in the plates 78 and 80. Vertical adjustment of the lower slide plates 172 may be provided by interposing shims, if needed, between the plates 78 and 80 and the slide plates themselves. However, the method of fabrication of the frame 16 normally does not require such adjustment of the crosshead slides.

Figure 6:
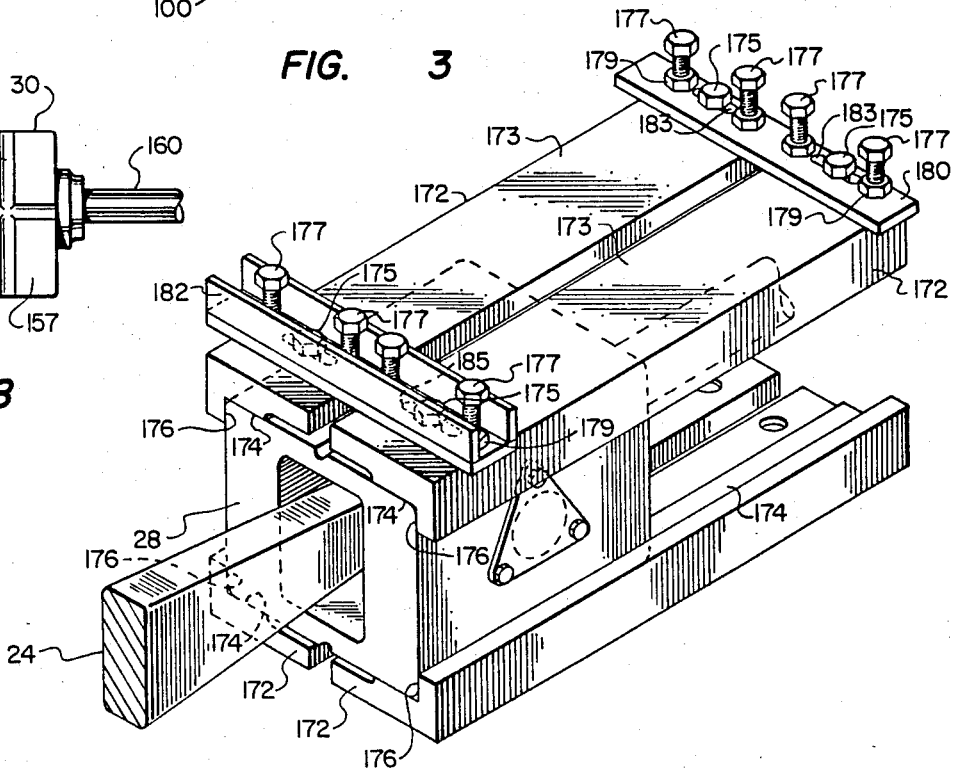
FIG. 6 is a perspective view of the crosshead and crosshead guide arrangement.

As shown by way of example in FIGS. 4 and 6, each of the crosshead support portions of the power end frame is provided with spaced apart transversely extending support members 180 and 182 which are adapted to support a second pair of crosshead slide plates 172 having their bearing surfaces 174 facing toward the bearing surfaces of the lower slide plates. The upper pair of slide plates 172 are secured to the support members 180 and 182 by bolts 175. The perspective view of FIG. 6 illustrates the crosshead 28 and, as shown by way of example in FIG. 6, the support members 180 and 182 for both crossheads are provided with elongated slots 183 and 185, respectively, so that the lateral position of the upper slide plates 172 may be adjusted.

The vertical positioning of the upper pair of slide plates 172 may be adjusted by spaced apart bolts 177 which extend through and are threadedly engaged with the members 180 and 182 and bear against surfaces 173 of the slide plates opposite the bearing surfaces 174. Each of the bolts 177 is provided with a locknut 179 for locking the bolts in their respective adjusted positions. Accordingly, the upper pair of slide plates 172 are suspended from the support members 180 and 182 by the spaced apart bolts 175 which, together with the bolts 177, may be adjusted to locate the bearing surfaces 174 of the slide plates to provide the proper bearing clearance for the bearing surfaces of the crossheads 28 and 30 and to provide for proper alignment of the crossheads with respect to the desired axis of reciprocation. Those skilled in the art will appreciate that the crosshead slides 172 may be easily fabricated separately from the frame 16 and may be replaced, if need be, in the event of damage to the bearing surfaces 174 or 176. Moreover, convenient adjustment of the slides 172 is provided by the support and adjusting arrangement illustrated and described in conjunction with FIGS. 4, 5 and 6. This unique arrangement eliminates the need to provide for line boring of a crosshead guide surface on the crosshead support portions of the frame 16. Since the crosshead slide plates 172 may be easily fabricated and machined to provide substantially flat bearing surfaces 174 and adjacent perpendicular bearing surfaces formed by the flanges 176, replacement of the crosshead support bearings formed by the plates 172 may be conveniently accomplished.

Figure 8:
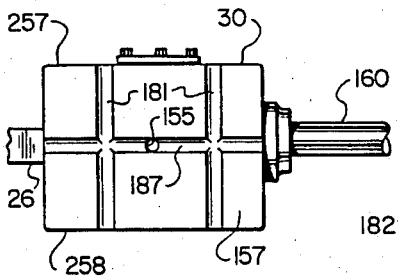
FIG. 8 is a detail plan view of one of the crossheads.

Referring to FIG. 8, by way of example, the crosshead 30 is provided with suitable lubricant conducting grooves 181 and 187 extending along the bearing surfaces 157 for distribution of lubricant. The bearing surface 158 is provided with similar grooves. As will be noted viewing FIGS. 4 and 5, the lubricant conduits 134 leading from the troughs 135 and 137 are disposed directly above and between the upper slide plates 172 so that lubricant draining through the conduits will flow onto the top surfaces of the crossheads 28 and 30, respectively. When the crossheads 28 and 30 move out of position underneath the tubes 134, lubricant is also allowed to drain onto the lower slide plates 172 and the support plates 78 and 80, therefor. As shown in FIG. 4, the connecting rod 24 is also provided with a suitable vertically extending passage 25 disposed directly above the crosshead pin 154 for receiving lubricant draining through an orifice 155 in the top wall of the crosshead 28 and in communication with the grooves 187 so that lubricating oil will drain into a sleeve bearing disposed in the connecting rod. The connecting rod 26 and crosshead 30 have the same configuration for providing lubricant to the required bearing surfaces.

The frame 16 is provided with several other access openings which are covered by suitable removable cover plates 274 and 277 as shown in FIGS. 1 and 7.

From the foreging description of the power end frame and drive mechanism for the pump 14, it will be appreciated that the unique fabricated structure of the frame, together with utilization of self-aligning bearings for the jackshaft, the eccentric shaft and the bearing connection between the eccentrics and the connecting rods, and further combined with the unique crosshead bearing or slide arrangement, provides a pump which may be fabricated without the need for large capital equipment.

The pump 14 is also provided with a unique fluid end structure which in itself is adapted to be fabricated utilizing commercially available steel tube and bar shapes and which may be finish machined to the exact desired dimensions by conventional turning machines and then welded together into a unitary assembly. Referring to FIGS. 2, 3 and 4, in particular, the cylinder assemblies 40 and 42 are substantially identical in construction and it is believed that the description of the cylinder 40 and the component parts therein will be sufficient to enable one skilled in the art to practice the instant invention. The cylinder member 40 comprises an elongated cylindrical tube having an interior bore 190 which may be stepped to accommodate the insertion of the liner 170 or may be provided with a separate tubular sleeve member 192 secured within the bore 190 by an interference fit. The liner 170 is removably secured within the bore 190 by a removable cylindrical retainer or junk basket 194 which is retained within the bore by a threaded head member 196. A suitable gasket is interposed between the head member 196, the bore 190 and the adjacent end of the retainer 194 to form a fluid tight seal to prevent fluid leakage out of the end of the cylinder 40. The head member 196 is of unique construction comprising an externally threaded plug 198 having a separate head portion 200 which is welded to the plug. The head portion 200 may be formed of steel tube and is provided with radially extending bores 202 spaced apart circumferentially and adapted for receiving a bar to serve as a wrench for inserting and removing the head 196 with respect to the cylinder 40. The liner 170 may be easily replaced by merely unthreading the head member 196 from the cylinder 40 and removing the retainer 190 and then the liner. This arrangement provides for more rapid changes of liners than prior art liner retaining arrangements.

The fluid end 18 is also characterized by four suction valve housings 206 which may be separately fabricated from cylindrical tube or bar stock and are interconnected with the respective cylinders 40 and 42 by conduit sections 208. Fluid is admitted to the interior of the respective suction valve housings by a manifold comprising a longitudinal pipe section 210 and laterally extending curved pipe sections 212. The pipe section 210 and the curved pipe or elbow sections 212 are welded together and to the lower or suction ends of each of the valve housings 206 to provide fluid inlet passage means to opposed chambers formed within the cylinders 40 and 42 and defined in part by the pistons 32 and 34. The elbow sections 212 are preferably standard prefabricated pipe fittings and the pipe section 210 may be formed from conventional steel pipe. As shown by way of example in FIG. 3, each of the housings 206 is provided with a suitable interior bore to receive a suction valve assembly 214 which is retained within the housing in a conventional way by a removable threaded head member 218. The head members 218 are constructed similar to the head members 196. The suction valve housings 206 are also interconnected by a pair of transverse brace members 216 as shown in FIGS. 2 and 3.

The fluid end 18 is further provided with four separately fabricated discharge valve housings 220 which are formed similar to the valve housings 206 and are mounted on the respective cylinders 40 and 42 as shown in the drawings figures. The lower ends of each of the valve housings 220 are received in laterally extending counterbores formed in the sidewalls of the cylinders 40 and 42 and are secured thereto by welding around the periphery of the contiguous edges of the valve housings. The valve housings 220 are each provided with interior chambers dimensioned to receive discharge valve assemblies 222 which are retained within the valve housings by removable threaded plug members 224 constructed similar to the plug members 218 and the head members 196. Referring to FIGS. 2 and 3, the valve housings 220 are interconnected by a manifold arrangement including laterally extending conduit portions 228 which converge to an inverted T-shaped pipe section 230 and are suitably welded thereto to form a unitary manifold and provide a common discharge conduit for the pumped fluid. The section 230 is provided with a suitable flange for connecting the discharge manifold to a pulsation dampener or the like 232.

The entire fluid end assembly 18 including the cylinders 40 and 42, the mounting flanges 168, the components making up the fluid inlet manifold, and the components making up the fluid discharge manifold are welded together to form a unitary structure. The fluid end 18 is suitably bolted to the flanges 66 and 68, as shown, and is provided with spaced apart support legs 234 which are welded to each of the cylinders 40 and 42 and are removably bolted to the flanges 105 of the skid 100. Substantially all of the components of the fluid end 18 are fabricated from commercially available plate and tube or bar stock using turning machines to machine the respective bores in the cylinders and in the valve housings. The suction and discharge valve assemblies are of the so-called poppet type, several versions of which are commercially available.

The present invention further contemplates a method of fabrication of a pump such as the pump 14 and, in particular, the fabrication of a power end frame generally of the type described and claimed herein. The method of the present invention will now be described in conjunction with FIGS. 9 through 11 of the drawings.

Figure 9:
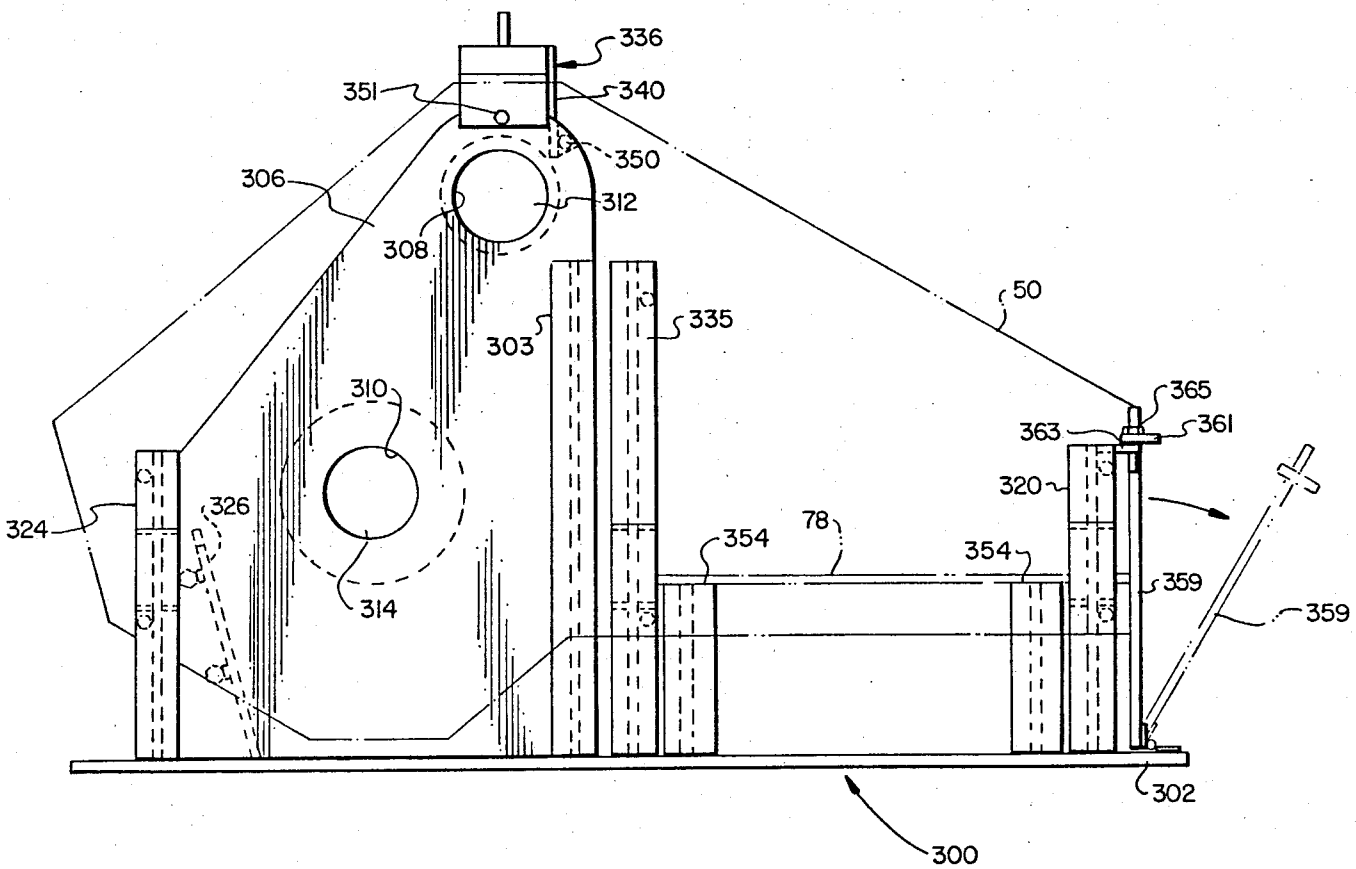
FIG. 9 is a side elevation of a fabrication fixture for manufacturing the power end frame of the pump illustrated in FIGS. 1 through 8.
Figure 10:
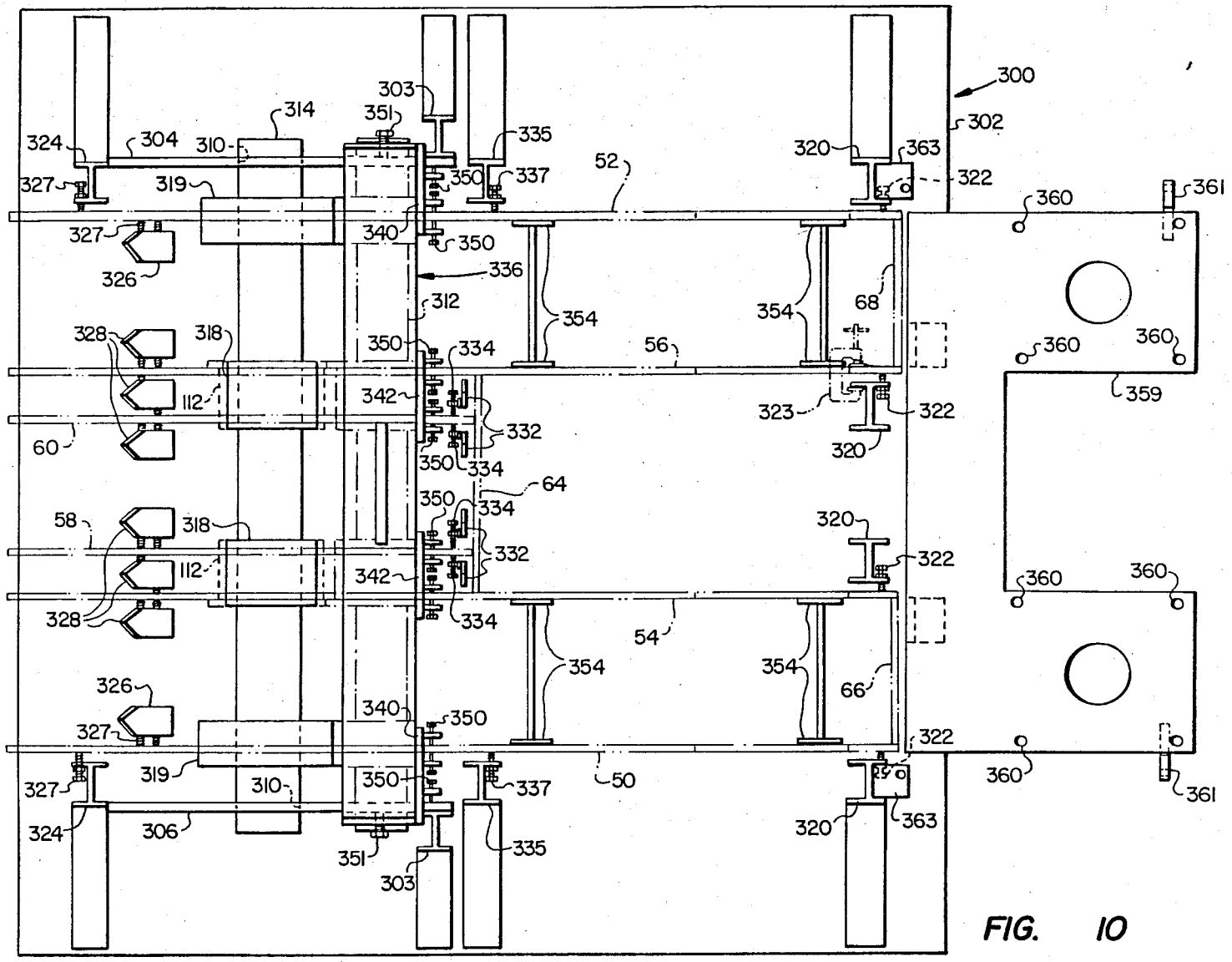
FIG. 10 is a plan view of the fixture illustrated in FIG. 9.
Figure 11:
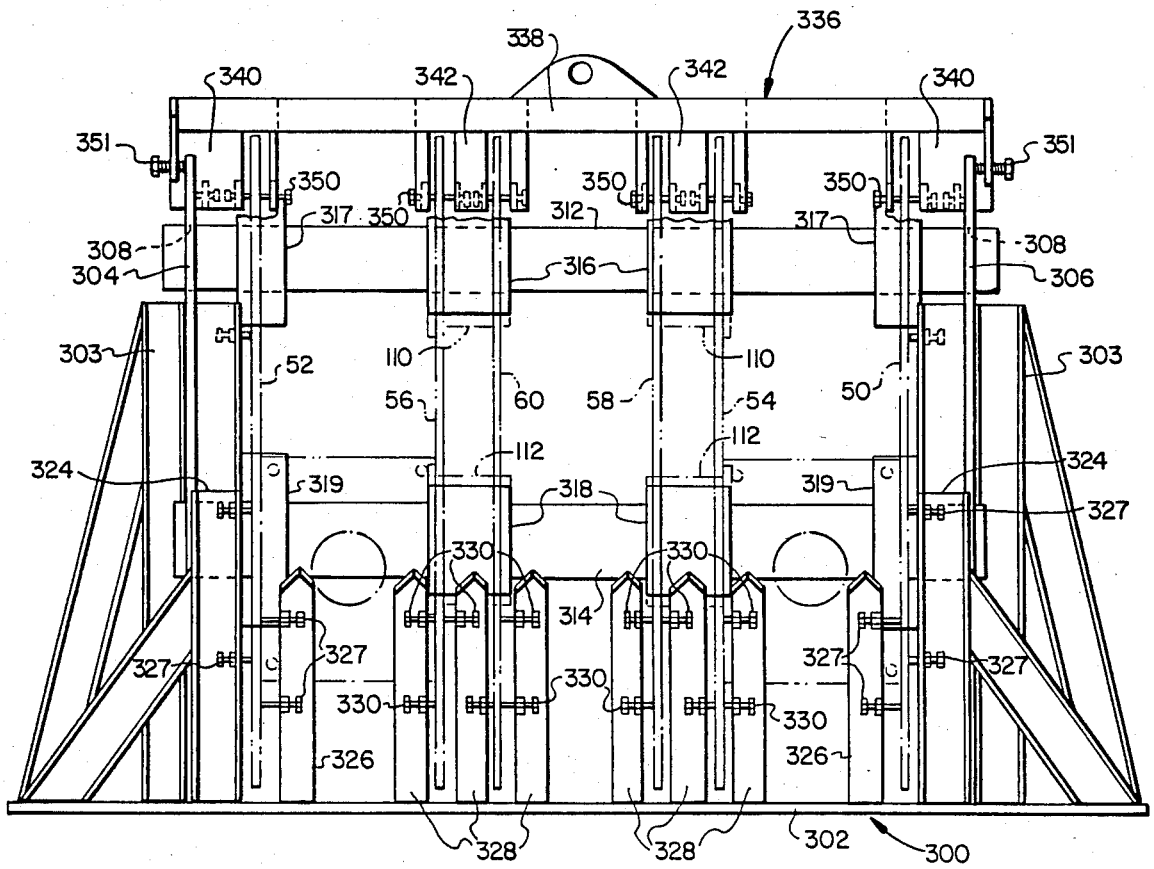
FIG. 11 is an end view of the fixture.

Referring to FIGS. 9 through 11, there is illustrated a fixture for use in connection with fabrication of the power end frame 16, which fixture is generally designated by the numeral 300. The fixture 300 includes a generally planar base member 302 and a pair of spaced apart upstanding sideplates 304 and 306. The sideplates 304 and 306 are supported by brace members 303 and are each provided with accurately aligned cylindrical bores 308 and 310 for receiving bearing sleeve locating shafts 312 and 314, respectively. The shafts 312 and 314 are provided with respective sets of cylindrical bearing sleeve mounting mixture members 316 and 318 on which the bearing sleeves 110 and 112 may be mounted, respectively. The fixture members 316 and 318 are dimensioned to provide for an accurate sliding fit of the sleeves 110 and 112 thereover, so that the members 316 and 318 and the shafts 312 and 314 may be removed from the plates 304 and 306 at will. Second sets of cylindrical fixture members 317 and 319 are slidably mounted on the shafts 312 and 314, respectively, and are adapted to locate the outer sidewall plates 50 and 52 by being disposed in cylindrical openings in the plate sidewalls, see also FIG. 7. The cylindrical fixture members 316 and 317 are shown partially broken away in FIG. 11 in order to illustrate additional fixture structure to be described further herein.

Referring to FIG. 10, the fixture 300 includes at one end thereof four, spaced apart, generally vertically upstanding stanchions 320. The stanchions 320 are provided with spaced apart locating bolts 322 which extend laterally through the stanchions in threaded engagement therewith and are adapted to engage the sides of the power end frame plate members 50, 52, 54 and 56.

Removable "C" type clamps 323, one shown by way of example, may be used to hold the plate members to the stanchions and the actual alignment of the plate members with respect to each other may be adjusted by the "C" clamps and the locating bolts 322. The opposite end of the fixture 300 is also provided with spaced apart outer stanchions 324 and a series of intermediate upstanding stanchions 326 and 328. Each of the stanchions 326 cooperates with a stanchion 324 for locating and securing the respective outer sideplates 50 and 52 with respect to the fixture. Each of the stanchions 324 and 326 are provided with spaced apart locating bolts 327 threadedly connected to the stanchions and adjustable to bear against the sides of the plate members 50 and 52 to accurately position the plate members for welding the power end frame into a unitary assembly.

Adjacent sets of three each of the stanchions 328 are spaced apart from each other for accurately locating the desired position of the set of plate members 54 and 58 and the other set of plate members 56 and 60. The stanchions 328 are also provided with sets of spaced apart locating bolts 330 which may be adjusted to locate the position of the respective plate members. The fixture 300 is provided with a third set of stanchions 332, FIG. 10, which are located adjacent the opposite end of the plates 58 and 60 from the stanchions 328. The stanchions 332 are also provided with respective sets of spaced apart locating bolts 334 for clamping the plates 58 and 60 in the desired position with respect to the plates 54 and 56. A fourth pair of stanchions 335 are disposed adjacent the brace members 303 and in alignment with the stanchions 320 and 324, as shown in FIG. 10, and include plate locating bolts 337.

Accordingly, the plates 50, 52, 54, 56, 58 and 60 may be mounted in the fixture 300 in predetermined spaced apart and parallel relationship to each other. Moreover, the bearing sleeves 110 and 112 may be located in respective openings in the plates 54, 56, 58 and 60 and accurately aligned with respect to each other thanks to the shafts 312 and 314 and the sleeve fixture members 316 and 318. As shown in the drawing figures, the fixture 300 includes a removable section 336 which is adapted to be disposed above the locating shaft 312 for clamping the top edges of the longitudinal frame plate members in alignment with each other in accordance with the alignment provided by the aforementioned stanchions. The fixture section 336 includes an elongated beam member 338 having spaced apart downwardly extending bifurcated locating fingers 340 and 342, FIG. 11. The locating fingers 340 and 342 are provided with suitable spaced apart plate locating bolts 350 and 351, shown arranged in opposed pairs, and adapted to secure the fixture section 336 to the plates 304 and 306 and to clamp the upper edges of the plate members 50, 52, 54, 56, 58 and 60 in proper aligned relationship. The fixture section 336 may be conveniently lifted onto and off of the top edges of the plates 304 and 306 for use in maintaining the top portions of the plate members 50 through 60 in alignment with each other during the welding of the plate members to the bearing sleeves and to additional portions of the power end frame including the vertically inclined rear wall portion 62, the transverse vertical wall 64 and the intermediate wall portions 70 and 72.

As shown in FIGS. 9 and 10, the fixture 300 also includes support portions 354 disposed generally between the stanchions 320 for supporting the horizontally extending crosshead support members 78 and 80 so that these members may be welded along their opposite longitudinal edges to the respective frame plate members.

In the fabrication of the power end frame 16, it is important that the mounting flanges formed by the plate members 66 and 68 be accurately aligned on the frame 16. Accordingly, the fixture 300 is provided with a support frame 359 for the flanges 66 and 68, which support frame is hingedly connected to the base 302 and includes spaced apart locating holes 360 which are provided for mounting the flanges 66 and 68 on the support frame. The support frame 359 may be moved from a generally horizontally disposed position, at which the plates 66 and 68 may be attached thereto, into a generally vertically disposed position to locate the flanges 66 and 68 in the desired position for welding these parts to the forward end of the plate members 50, 52, 54 and 56, respectively. The support frame 359 is provided with cooperating locating ears 361 and 363 having cooperating locating holes in which pins 365, one shown in FIG. 9, may be removably disposed for connecting the support frame to the outer pair of the stanchions 320 in the vertically disposed position of the support frame shown in FIG. 9.

The power end frame 16 is advantageously fabricated to have the premachined support sleeves for the eccentric shaft and jackshaft bearings accurately aligned with each other and to have the mounting flanges 66 and 68 accurately aligned with respect to the bearing sleeves thanks to the arrangement of the fixture 300 described hereinabove. Moreover, the power end frame 16 is fabricated with greater accuracy of the location of the respective parts and without distortion of the frame members during welding of the frame into a unitary assembly. The power end frame 16 is preferably fabricated in accordance with steps which include precutting the plate members 50, 52, 54, 56, 58 and 60 to their final shape. The plate members 62, 64, 66, 68, 70, 72, 74, 76, 78 and 80 are also precut using conventional flame or arc cutting equipment. The plates 50, 52, 54, 56, 58 and 60 are then mounted in the fixture 300 and generally aligned with respect to the stanchions 320, 324, 326, 328 and 332 by adjusting the respective locating bolts until all of the plates are substantially parallel and spaced apart as desired. The shafts 312 and 314 are then inserted in the respective bores 308 and 310 in the sideplates 304 and 306 and concomitantly the bearing sleeves 110 and 112 are slid onto the fixture members 316 and 318 and the fixture members over the shafts as the shafts are inserted in the fixture 300. The fixture members 319 and 321 are also utilized to assist in locating the frame plates 50 and 52 by being located in cooperating cylindrical openings in the frame plates. The removable fixture section 336 is installed along the top side of the respective plate members and clamped thereto to maintain the plates in alignment along their top edges. The sleeves 110 and 112 may then be welded to the respective plates along contiguous surfaces. A final alignment of the plate members 50, 52, 54, 58 and 60 may be required prior to commencing the welding operations. The wall plates 62, 64 and the horizontally extending crosshead support plates 78 and 80 may also then be welded along their contiguous edges with the longitudinally extending frame plate members. The front vertical wall portion of the crosshead support parts of the frame 16, formed by the plate members 70 and 72, may then also be welded in place together with the crosshead slide support members 180 and 182.

Finally, the hinged support frame 359 may be swung into position to locate the flanges 66 and 68 with respect to the longitudinal frame plates whereupon the flanges may be welded along their contiguous edges to the respective plate members 50–54 and 52–56.

Locating pins, now shown, disposed in the holes 360 for locating the flanges 66 and 68 may then be removed and the support frame 359 lowered to its retracted position. The top front wall members 74 and 76 may then be welded along the respective edges contiguous with the adjacent plate members. The webs 96 and 98 may also be welded in place while the power end frame 16 is in the fixture 300 or these components may be welded in place after the frame is removed from the fixture. In like manner, the bottom wall parts 82, 84 and 86 as well as the top wall portion 88 may also be welded in place after the basic frame structure is removed from the fixture 300. When the frame 16 is ready for removal from the fixture, the fixture section 336 is released and removed from the plates 304 and 306. The shafts 312 and 314 are slid out of the respective bores 308 and 310 in the sideplates 304 and 306 and the fixture members 316 and 318 are removed from the respective bearing sleeves 110 and 112. The members 317 and 319 are also removed as the shafts 312 and 314 are slid out of the fixture sideplates. The locating bolts and "C" clamps are released whereby the aforedescribed power end frame section may be lifted out of the fixture 300 for further welding of the plate members described above and for mounting on the skid 100.

Those skilled in the art will appreciate from reading the foregoing description, that a unique reciprocating piston pump is provided by the instant invention which does not require machining after completion of the fabrication of the power end frame. The pump is relatively lightweight, is also characterized by a unique crosshead bearing arrangement and may be fabricated using equipment requiring a lower capital investment then the art of manufacturing large drilling mud pumps has heretofore required. Various substitutions and modifications may be made to the pump structure and the method of fabrication described herein without departing from the scope of the invention as recited in the appended claims.

What I claim is:

1. A method for fabricating a power end frame for a reciprocating piston pump wherein said frame is adapted to support spaced apart bearing means for at least a rotatable eccentric shaft, said method comprising:

providing a fixture including spaced apart support members for locating and supporting a plurality of metal plate members comprising bearing support means of said frame, said fixture further including means for supporting a shaft for locating at least two spaced apart tubular bearing support sleeves in alignment with each other and for being secured to said plate members;

cutting said plurality of plate members to a predetermined shape including openings for receiving said bearing sleeves;

machining said bearing sleeves to a predetermined bore diameter for receiving respective bearings assemblies;

placing said plate members in said fixture and aligning said plate members with respect to each other;

positioning said bearing sleeves in said openings in said plate members and supporting said bearing sleeves with said shaft; and welding said plate members and said bearing sleeves to each other along contiguous surfaces to form said frame.

2. The method set forth in claim 1 together with the steps of:

removing said shaft from said bearing sleeves; and removing said frame from said fixture.

3. The method set forth in claim 1 wherein:

said fixture includes means for supporting a pair of spaced apart mounting flanges of said frame, said flanges being adapted for connecting said frame to a pump fluid end assembly, and said method includes:

mounting said flanges on said flange supporting means;

positioning said flange supporting means on said fixture using locating members cooperable with said flange supporting means and said fixture;

welding said mounting flanges to said plate members along respective contiguous edges; and disconnecting said flanges from said flange supporting means before removing said frame from said fixture.

4. The method set forth in claim 3 wherein:

said flange supporting means includes a supporting frame hinged to said fixture and movable from a reclining position for mounting said flanges on said supporting frame to a position for locating said flanges with respect to said plate members.

5. The method set forth in claim 1 or 4 together with the steps of:

providing crosshead support plates for said frame;

locating said crosshead support plates on said fixture; and welding said crosshead support plates to said plate members along respective contiguous edges.

6. The method set forth in claim 1 wherein:

said support members for said plate members of said frame include position locating means for said plate members comprising plural spaced apart threaded members threadedly engaged with said support members and adapted to engage said plate members for aligning said plate members with each other, said step of aligning said plate members including adjusting said threaded members, respectively.

* * * * *